US005419403A

United States Patent [19]

Klemm

[11] Patent Number: 5,419,403

[45] Date of Patent: May 30, 1995

[54] PNEUMATIC HAMMER

[75] Inventor: Guenter W. Klemm, Olpe, Germany

[73] Assignee: Ing. G. Klemm Bohrtechnik GmbH, Germany

[21] Appl. No.: 81,274

[22] PCT Filed: Oct. 23, 1992

[86] PCT No.: PCT/EP92/02435

§ 371 Date: Jun. 22, 1993

§ 102(e) Date: Jun. 22, 1993

[87] PCT Pub. No.: WO93/08364

PCT Pub. Date: Apr. 29, 1993

[30] Foreign Application Priority Data

Oct. 23, 1991 [DE] Germany ..... 41 34 956.3

[51] Int. Cl.[6] ..... E21B 4/14

[52] U.S. Cl. ..... 173/115; 173/206; 173/78

[58] Field of Search ..... 173/115, 17, 78, 80, 173/206; 91/277, 321

[56] References Cited

U.S. PATENT DOCUMENTS

| | | | |
|---|---|---|---|
| 3,714,789 | 2/1973 | Chelminski | 173/115 X |
| 3,924,690 | 12/1975 | Shaw . | |
| 4,062,411 | 12/1977 | Adkins et al. | 173/115 |
| 4,194,581 | 3/1980 | Walter . | |
| 4,278,135 | 7/1981 | Curington | 173/115 X |
| 4,817,737 | 4/1989 | Hamada et al. | 173/115 |
| 4,878,550 | 11/1989 | Chuang . | |
| 4,951,757 | 8/1990 | Hamada et al. | 173/115 |
| 5,205,363 | 4/1993 | Pascale | 173/17 |

*Primary Examiner*—Rinaldi I. Rada
*Attorney, Agent, or Firm*—Diller, Ramik & Wight

[57] ABSTRACT

A pneumatic hammer is provided which includes a working piston (16) movable in a working cylinder (22) and defining therewith front and rear cylinder working chambers (23, 24, respectively). The working piston (16) impacts upon an anvil (15) to drive a drill bit (12) through utilizing a source of compressed air. An adjusting mechanism (37) adjusts the length of the return stroke of the working piston (16) in dependence upon the supply pressure of the compressed air.

9 Claims, 5 Drawing Sheets

PNEUMATIC HAMMER

BACKGROUND OF THE INVENTION

Such pneumatic hammers are used for ground or rock drilling. They may be implemented in connection with drilling machines that advance and rotate drill rods with a drill bit from a boring frame. In this case, the pneumatic hammer is generally designed as a in-hole hammer which is arranged immediately behind the drill bit in the drill rods. Further, pneumatic hammers may be designed as hand-held hammers, so-called compressed air hammers, which are operated by hand in order to do demolition work or ground and rock work. With a hand-held hammer, the drill bit generally is a simple trepan.

In pneumatic hammers with pin drill bits, the impact energy supplied by the working piston is transmitted to the hard metal pins or bezels for cleaving rock via the drill bit. The impact frequency is determined by the quantity of compressed air supplied or by the quantity transmitted by the pneumatic hammer. By rotating the entire drilling tool, the bottom of the bore hole is cleft and stripped and the drilling material is transported to the outside by the relaxing and outflowing discharge air in the annular gap between the drill rod and the inner wall of the drill rod.

The drilling capacity is chiefly determined by the following factors:

- The single impact energy imparted on the drill bit by the working piston during every blow;
- the number and the surface of the drill bit pins on which the impact energy is distributed and which transform that energy into penetration and cleaving work;
- the impact frequency;
- the pressure of the drilling tool on the bottom of the bore hole;
- the removal of the drillings or the purging or rinsing of the bottom of the bore hole to clean the same of the drillings.

The drive energy required for pneumatic hammers is supplied by compressors. Normally, the supply pressure is about 7 to 10 bar and the supply quantity is about 5 $m^3$/min.

Recently, high pressure compressors are used on building sites that supply a pressure in the magnitude of 20 bars. Such high pressure compressors are also used to drive the pneumatic hammers used on a building site, even if these pneumatic hammers were originally designed for pressures between 7 and 10 bars. For such high pressure operation, the principle of these pneumatic hammers has not been changed; only certain elements of the hammer have been provided with a greater strength or a greater thickness. This results in the same pneumatic hammers being operated in a wide range of supply pressures between 7 and 25 bars. With a higher supply pressure, the impact frequency and the impact energy will increase, but the drilling capacity is not enhanced correspondingly. This is due to the fact that the impact energy per drill bit pin is essential for the drilling capacity. The drilling capacity will only be optimal, if the impact energy per drill bit pin is maintained in a certain range. Above this range, the cleaving depth of the rock (cleaving work) is not substantially improved, although the consumption of compressed air increases vastly. Thus, the actual drilling capacity is far behind the installed power of the compressor, which results in a low efficiency. Additionally, a high impact energy of the working piston generates a jarring blow on the anvil. Such jarring blows cause an enormous stress on the drill bit shaft and the working piston, often resulting in ruptures of shafts and pistons. In manually operated pneumatic hammers, the jarring blows caused by an excessive supply pressure entail serious physical stresses on the operator, including the risk of detrimental effects on his health and in particular on the skeletal structure.

The operator of a drilling device will usually obtain the drilling tools, the compressor, the pneumatic hammer and the drill bit from different manufacturers, respectively. As a rule, this leads to an untuned combination of elements being implemented. The operator is not able to select the components such that an optimal drilling capacity with a high efficiency can be obtained with a simultaneous low stress on the material.

SUMMARY OF THE INVENTION

It is an object of the invention to provide a pneumatic hammer that may be operated at different supply pressures and, in a wide range of supply pressures, yields a high drilling capacity with a high efficiency, while simultaneously keeping the stress on the material low.

In the pneumatic hammer of the present invention, an adjusting means is provided at the rear cylinder chamber of the working cylinder, which serves to change the stroke of the working piston. Thus, the impact energy imparted on the anvil by the working piston may be kept substantially constant in a wide range of supply pressures. At high supply pressures of the compressed air, the piston stroke is reduced so that the piston will hit on the anvil at substantially the same speed as it will at low supply pressures. Despite the great acceleration caused by a high supply pressure, the impact speed on the anvil is not substantially higher than at a low supply pressure. Of course, a high supply pressure and a correspondingly shortened stroke of the working piston will result in a higher impact frequency than would be obtained at low supply pressures. This increases the drilling capacity without reducing the efficiency. The volumetric consumption of compressed air is even reduced.

Preferably, the adjusting means changes the beginning of the compression period at the return stroke of the working piston. Thus, the length of the return stroke is changed by changing the volume of the rear cylinder chamber in which an air cushion forms.

In general, it is possible to provide a pneumatic hammer with an adjusting means that is either mounted directly on the hammer housing or may be remote-controlled by means of a transmission device. It is also possible to provide a pneumatic adjusting means, the pressure of which may be adjusted manually irrespective of the supply pressure of the compressed air. Such manual adjusting means allow a user to influence the stroke of the working piston.

In many instances, the operator is not able to adjust the correct stroke length. According to a preferred embodiment it is therefore provided to automatically control the stroke length depending on the supply pressure. This automatic adjusting means is arranged within the pneumatic hammer so that all pressure losses in the conduit system or the rods leading to the pneumatic hammer are taken into account. The supply pressure actuating the adjusting means is not the pressure supplied by the compressor, but the pressure immediately present at the pneumatic hammer, which also causes the acceleration of the working piston.

The supply pressure at the pneumatic hammer does not have to be used unchanged for controlling the adjusting means. It is also possible to effect a proportional pressure transformation, for instance, and to control the adjusting means with a pressure depending on the supply pressure.

In addition to the automatic control of the adjusting means, a manual adjusting means may be provided, for instance, in order to adjust the impact energy to the number drill bit pins.

Preferably, the invention is applicable with in-hole hammers that are arranged in a drill rod, as well as with hand-held hammers and demolition hammers. With the latter, maintaining the single-impact energy prevents the transfer of reflected energy into the wrists and arms of the user and the occurrence of damages to the user's health.

In compressors having no adjustable air pressure, or in compressors connected to a plurality of air consumers that require air pressure, the pneumatic hammer automatically adapts itself to the supply pressure, which results in a substantially constant impact energy regardless of the supply pressure and that a high supply pressure merely increases the impact frequency. The elements of the pneumatic hammer are subjected to lesser stresses and their service life is prolonged.

The following is a detailed description of embodiments of the invention in conjunction with the accompanying drawings.

In the Figures

DESCRIPTION OF THE PREFERRED EMBODIMENTS

Figure 1:
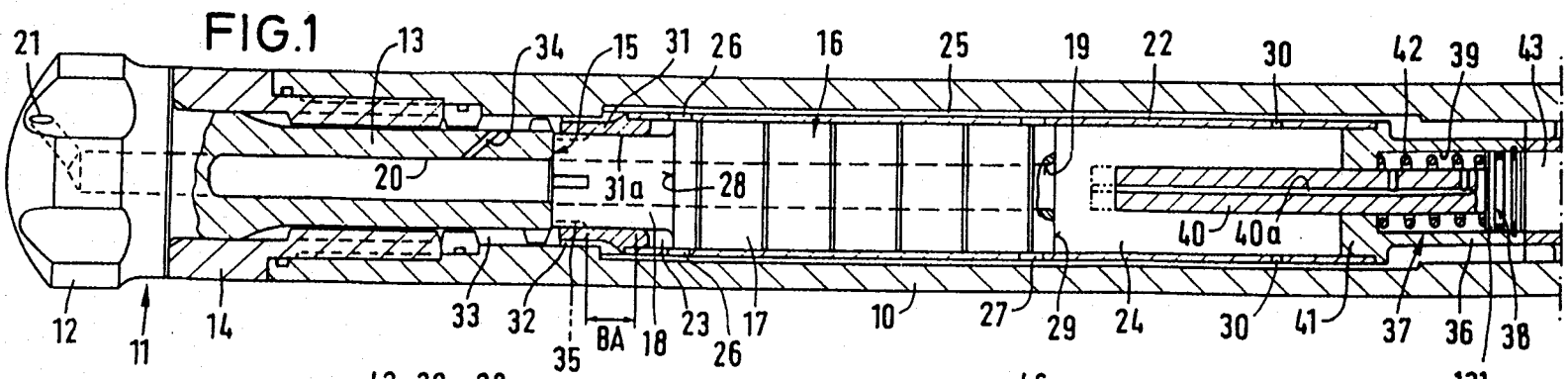
FIG. 1 shows the front portion of a pneumatic hammer as a deep-hole hammer in a drill rod.
Figure 2:
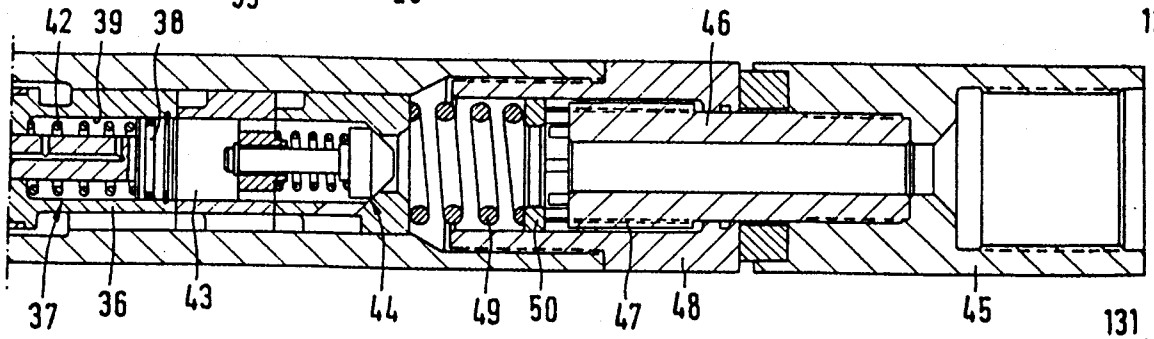
FIG. 2 shows the rear portion of the in-hole hammer of FIG. 1.

The pneumatic hammer illustrated in FIGS. 1 and 2 is a in-hole hammer with an elongated tubular hammer casing 10 from the front end of which the head 12 of a drill bit 11 protrudes. The drill bit head 12 is provided with hard metal pins (not illustrated). The shaft 13 of the drill bit 11 extends into the hammer casing 10. Through a key toothing, the shaft engages an adapter 14 screwed into the hammer casing 10, in order to transmit the rotation of the hammer casing to the drill bit 11. The drill bit shaft 13 is guided for limited longitudinal displacement so that, in case of impacts on the rear end of the shaft 13, the drill bit 11 can shoot forward with respect to the casing 10. The rear end of the drill bit shaft 13 forms the anvil 15 on which the working piston 16 beats. The working piston 16 consists of a piston body 17 with sealing grooves, and the adjoining cylindrical shaft 18 of reduced diameter that beats against the anvil 15 with its front face. A bore 19 extends through the entire length of the piston 16, which is aligned with a longitudinal bore 20 of the drill bit 11. The head 12 of the drill bit is provided with outlets 21 that are connected with the longitudinal bore 20. The expanded discharge air of the pneumatic hammer escapes from these outlets for washing back the drilling material from the bottom of the bore hole.

The piston 16 is guided for longitudinal displacement within a tubular inner working cylinder 22, the front cylinder chamber facing the drill bit 11 being designated by the reference numeral 23, while the rear cylinder chamber facing away from the drill bit bears the reference numeral 24. The inner cylinder 22 is enclosed by an annular channel 25 through which the compressed air is transported over the entire length of the inner cylinder 22. The inner cylinder 22 has radial control bores 26 and 27, the control bore 26 cooperating with a front control surface 28 and the control bore 27 cooperating with a rear control surface 29 of the cylinder body 17. Moreover, the rear end portion of the inner cylinder 22 is provided with a support bore 30 through which compressed air reaches the rear cylinder chamber 24.

Provided at the front end of the working cylinder 22, there is a guide sleeve 31 fixedly mounted in the hammer casing and having longitudinal grooves 32 that connect the annular channel 25 to an annular channel 33 surrounding the drill bit shaft 13. Throttle bores 34 lead from this annular channel 33 to the longitudinal bore 20 of the drill bit shaft in order to lead a part of the compressed air past the hammer into the flushing channel. The guide sleeve 31 provides a sealed guiding of the shaft 18 of the working piston 16. The end of the shaft 18 is provided with short longitudinal grooves 35.

The rear cylinder chamber 24 is closed at the rear by an insert 36 that receives the adjusting means 37. The adjusting means 37 includes the adjusting piston 38 displaceable in a control cylinder 39 of the insert 36 and from which a control tube 40 projects forward which extends through a bore of the front cylinder wall 41. The adjusting piston 38 includes a conventional piston head 131 having a conventionally outwardly opening circumfrential groove (unnumbered) in which is seated a conventional annular O-ring seal 132. A conventional O-retaining ring 133 is seated in a groove (unnumbered) in an internal surface (unnumbered) of the control cylinder 36 for conventionally limiting the movement of the piston 38 in a rearward (to the right in FIG. 4) direction. An inner peripheral face of the control cylinder 39 has a conventional chamfere surface 134. The channel **40*a* of the control tube 40 is always in pneumatic communication with the longitudinal bore 20 and the inside of the control cylinder 39 so that the low relaxed pressure always prevails in the control cylinder 39. A spring 42 is provided in the control cylinder 42 that presses the adjusting piston 38 backward. The rear end of the adjusting piston 38 is connected to a pressure chamber 43** in which the supply pressure constantly prevails.

According to FIG. 2, a check valve 44 is arranged behind the pressure chamber 43, which, in case that pressing water should rise from the drill bit against the compressed air supplied, will block the path of such water. The check valve 44 is actuatable only in the direction from the drill rod 45 to the bottom of the bore hole, but not in the reverse direction.

The rear end of the hammer casing 10 is connected to the front end of the drill rod 45 through an insert member 46, a key toothing 47 of the insert member 46 engaging with a key toothing of a sleeve 48 screwed into the hammer casing. The key toothings permit a limited axial displacement of the hammer casing 10 with respect to the drill rod 45. A spring 49 is supported on a support ring 50 which in turn is supported on the end of the key toothing of the sleeve 48. The spring 49 presses the fixed inner casing parts of the hammer axially together and permits displacements of these parts due to vibrations.

From the drill rod 45, the compressed air supplied reaches the pressure chamber 43 and the annular channel 25 through the hollow insert 46 and via the check valve 44.

The pneumatic hammer depicted in FIGS. 1 to 3 operates as follows:

In FIG. 1, the piston 16 is illustrated as being in its front end position in which the shaft 18 abuts the anvil 15. The front cylinder chamber 23 is reduced to a minimum and is connected to the pressure in the annular channel 25 through the control bore 26. In this situation, the return stroke of the working piston 16 begins since the rear cylinder chamber 24 is connected to the pressureless longitudinal bore 20 of the drill bit through the bore 19. During the return stroke, the working piston 16 experiences an acceleration phase. The pressure prevailing in the front cylinder chamber 23 and acting on the front control surface 28 accelerates the working piston 16. This acceleration phase will last until the rear ends of the longitudinal grooves 35 have reached the rear end of the guide sleeve 31. The corresponding acceleration section BA is marked in FIG. 1. After this, the cylinder chamber 23 is connected to the pressureless axial bore 20 by the grooves 35. The acceleration is followed by an idle phase in which the return stroke of the working piston 16 is not driven. The air displaced from the rear cylinder chamber 24 is discharged through the bore 19 in the working piston.

When the rear control surface 29 of the working piston reaches the front end of the control tube 40, the idle phase is ended. Next to follow is the compression phase in which the air in the annular chamber of the working cylinder 22 surrounding the control tube 40 is compressed. The control tube 40 now closes the opening of the bore 19.

Figure 3:
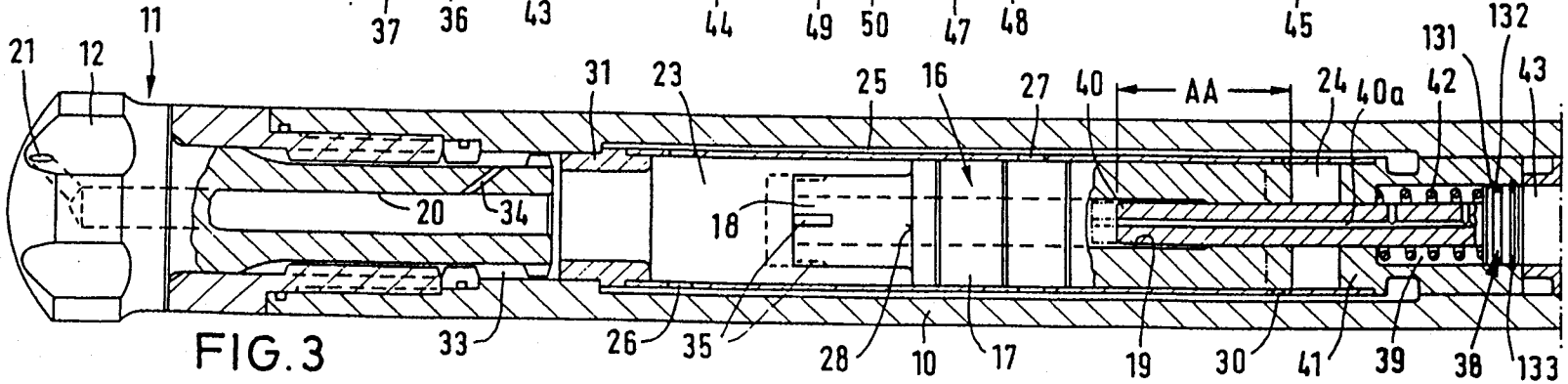
FIG. 3 shows the front portion of the in-hole hammer with the working piston located in the rear end position.

FIG. 3 depicts the state in which the working piston has reached its rear end position. The air in the cylinder chamber 24 is strongly compressed. This air cushion has slowed down the rearward movement of the working piston. Now the working stroke is effected in which the air cushion compressed in the cylinder chamber 24 expands and drives the working piston in the direction of impact. This driving force is even augmented by the air passing through the support bore 30. The drive phase ends when the rear control edge 29 of the working piston 16 has passed the front end of the control tube 40. The drive section, in which the working piston 16 is accelerated in the direction of the impact, is indicated by AA in FIG. 3.

At the end of the working stroke the shaft 18 of the working piston 16 hits the anvil 15, an air cushion having been formed in the front cylinder chamber 23 short before the impact.

The operation described before refers to cases where the supply pressure of the compressed air has a comparatively low value of about 7 to 10 bar. Such a pressure in the pressure chamber 43 is overcome by the spring 42 so that the adjusting piston 38 is moved into its rear end position against this pressure and that the control tube 40 also takes its rear end position.

If the control pressure is higher, the adjusting piston 38 is advanced together with the control tube 40, the distance of advancement being dependent on the supply pressure. With a higher supply pressure, the idle phase is shortened. This has the effect that the control surface 29 reaches the front end of the control tube 40 earlier and that the compression phase will begin earlier. This reduces the stroke of the piston (return stroke) so that the following working stroke of the working piston begins at a location closer to the front side. On the other hand, the compression in the rear cylinder chamber 24 is lower, due to the larger volume, than when the control tube is withdrawn. The stroke of the working piston is thus reduced so that, despite the higher supply pressure, the speed at which the working piston hits on the anvil is substantially the same as the impact speed that is obtained at a lesser supply pressure and with the control tube 40 withdrawn.

The advanced position of the control tube 40 may be selected such that, during the return stroke, the acceleration phase and the compression phase follow each other immediately or even overlap without an intermediate idle phase.

Figure 4:
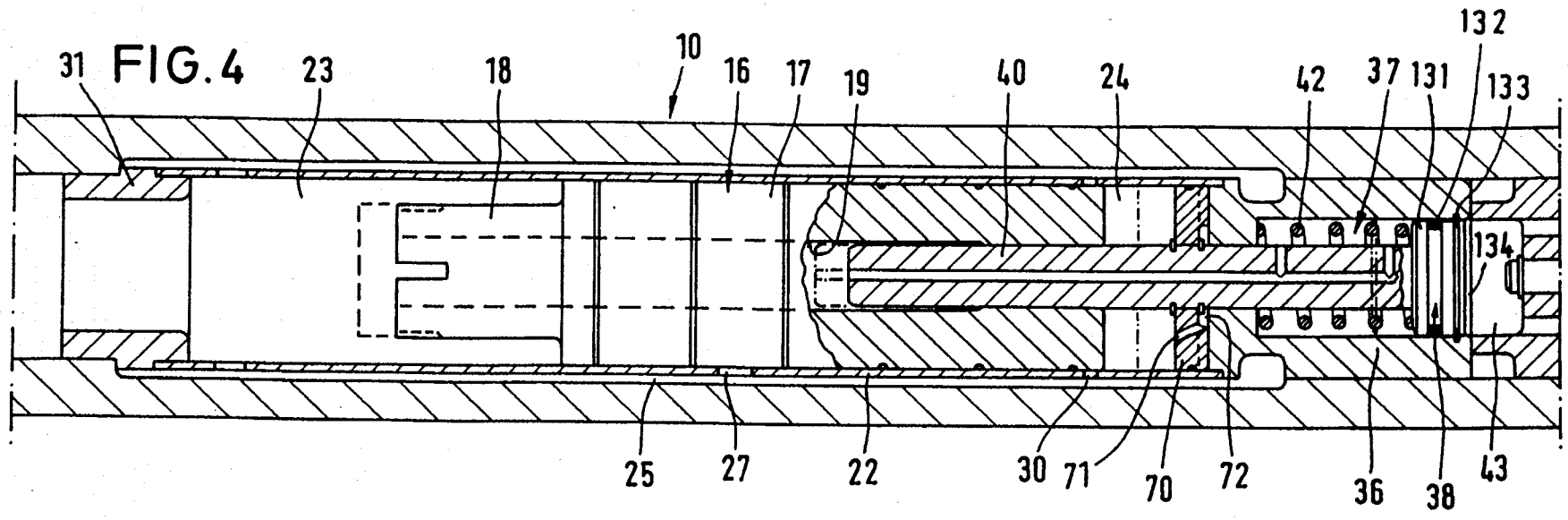
FIG. 4 shows an embodiment in which the adjusting means commonly adjusts a control tube and a control wall of the working piston.

The embodiment of FIG. 4 corresponds to that of FIGS. 1 to 3 so that the following will only explain the differences. Fixed to the control tube 40 there is a disc 70 that moves along with the control tube in its pressure-depending movement caused by the adjusting piston 38. A throttle channel 71 extends through or past this disc 70. In the chamber 72 between the disc 70 and the insert 36, a chamber 72 is formed that becomes bigger or smaller depending on the supply pressure of the compressed air. This chamber 72 is connected to the rear cylinder chamber 24 through the throttle channel 71. The pressure in the chamber 72 follows the pressure in the rear cylinder chamber 24 with a certain delay created by the throttle channel 71. Thus, an inert pressure cushion is formed in the chamber 72. The disc 70 reduces the volume of the working cylinder corresponding to the supply pressure of the compressed air, as shown in phantom outline. Thereby, the rear end of the cylinder chamber 24 is displaced forward (to the left) when the supply pressure increases, whereby at higher supply pressures the length of the return stroke of the piston is reduced because of the shorter length of the rear cylinder chamber 24.

Figure 5:
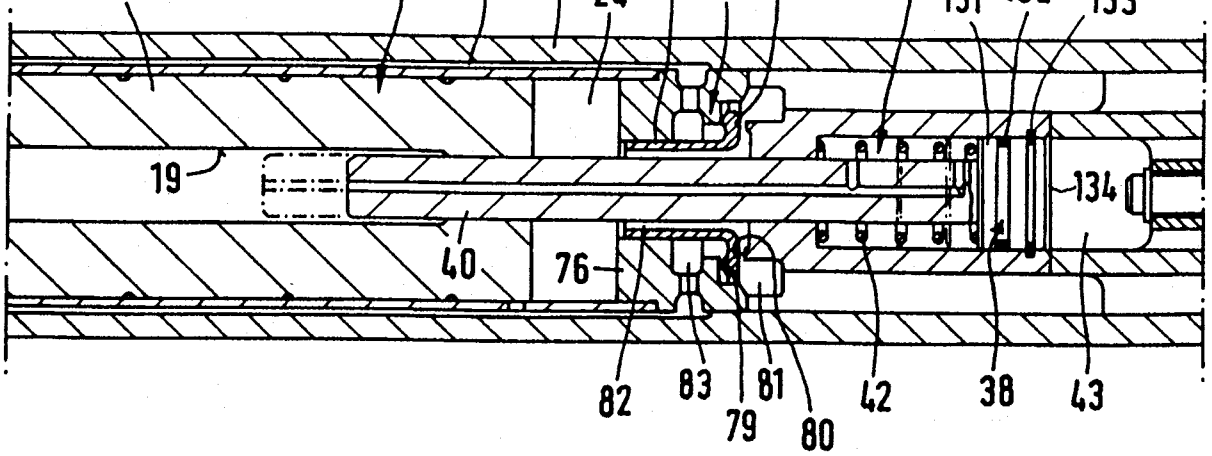
FIG. 5 shows an embodiment with a pressure-depending reversing valve for achieving a higher number of impacts.

The embodiment shown in FIG. 5 also largely corresponds to the one of FIGS. 1 to 3 so that the following is limited to the explanation of the differences. At the rear end of the working cylinder, a pressure-dependent reverse valve 75 is arranged before the adjusting means 37, the valve being embodied as a sleeve valve accommodated in the rear end wall 76 of the working cylinder. The valve 75 has a tubular valve body or tube 77, one end 78 of which is widened in a cuff-like manner. The widened end 78 alternately cooperates with one of two valve seats 79 or 80. The tube 77 of the valve 75 surrounds the control tube 40 with a radial space. It is axially displaceable, its end 78 either abutting the seat 79 or the seat 80. The inlet of the valve 75 is connected to an annular channel 81 in which the supply pressure prevails. One outlet of the reverse valve 75 is formed by the annular space 82 inside the tube 77, while the other outlet is formed by the annular space 83 that encloses the tube 77 and is connected to the annular channel 25. The reverse valve is controlled by the pressures in the annular spaces 82 and 83. If the pressure in the annular space 83 is higher, the end 78 is pressed against the seat 80 and the annular space 83 (and the annular channel 25) are supplied with the supply pressure. If, however, the pressure in the cylinder chamber 24 (and thus in the annular space 82) is higher, the end 78 is pressed against the valve seat 79, whereby the cylinder chamber 24 is supplied with the supply pressure, while the annular space 83 becomes pressureless. The reverse valve 75 supports the working stroke and its action increases the impact frequency of the pneumatic hammer.

Figure 6:
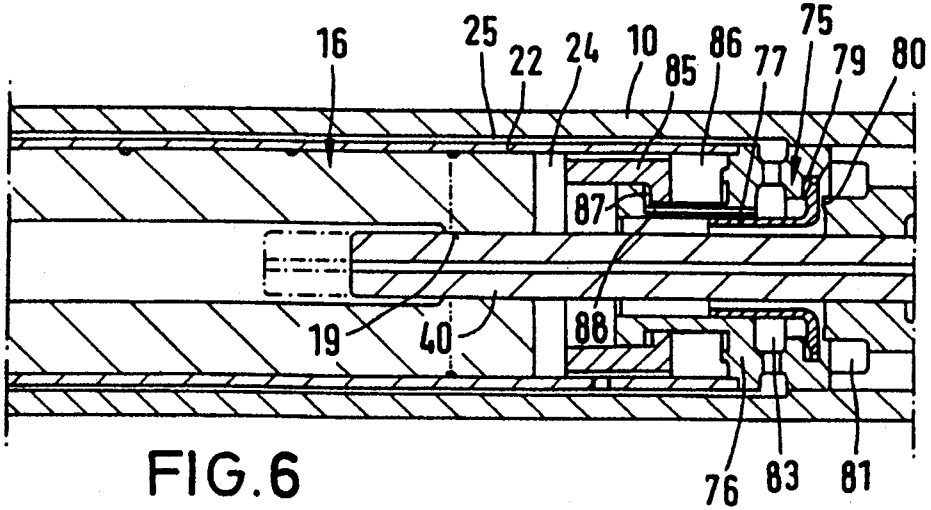
FIG. 6 shows an embodiment similar to that of FIG. 5, but, in addition, with a working piston reducing the size of the rear cylinder chamber.

The embodiment of FIG. 6 differs from that in FIG. 5 in that the rear cylinder wall 76 includes an axially slidable annular piston 85, the piston chamber 86 of which is in permanent connection with the cylinder chamber 24. Opposite the piston chamber 86, a further piston chamber 87 is provided that is connected to the annular space 83 through a throttle channel 88. In this way, the pressure of the piston chamber 86 is always the same as that in the cylinder chamber 24. The pressure in the piston chamber 87 is always the same as that in the annular channel 25 which pressure varies depending on the position of the pressure-dependent reverse valve 75. In its advanced position, when the pressure in the piston chamber 86 is larger, the piston 85 protrudes into the cylinder chamber 24, while, in the retracted position, when the pressure in the piston chamber 87 is larger, it is flush with the cylinder wall 32. The piston 85 forms a part of the rear cylinder wall 76 arranged spaced from the drill bit. Due to the throttle channel 88, the piston 85 cannot follow the periodical pressure changes fast enough so that it adjusts itself to an intermediate position that depends on the magnitude of the supply pressure or the magnitude of the maximum pressure prevailing in the cylinder chamber 24. Thereby, the volume of the working cylinder is changed in dependence on the pressure such that this volume decreases at high pressures. This change of volume is performed in addition to the shortening of the stroke caused by the adjusting means 37.

Figure 7:
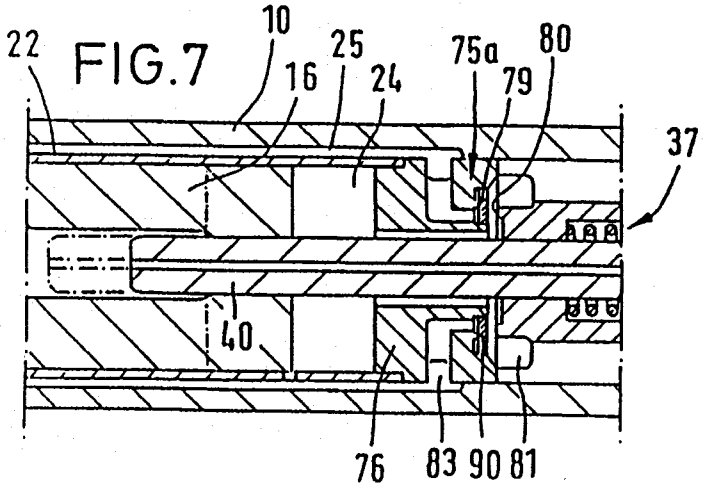
FIG. 7 shows an embodiment similar to that of FIG. 4, however, with an differently constructed pressure-depending reversing valve.

The embodiment of FIG. 7 corresponds largely to that of FIG. 5, a lamella valve with a movable lamella 90 is used as the reverse valve 75*a*, which may be alternately set against the valve seats 79 and 80. This embodiment of the reverse valve 75*a* has the same effect as the reverse valve 75.

Figure 8:
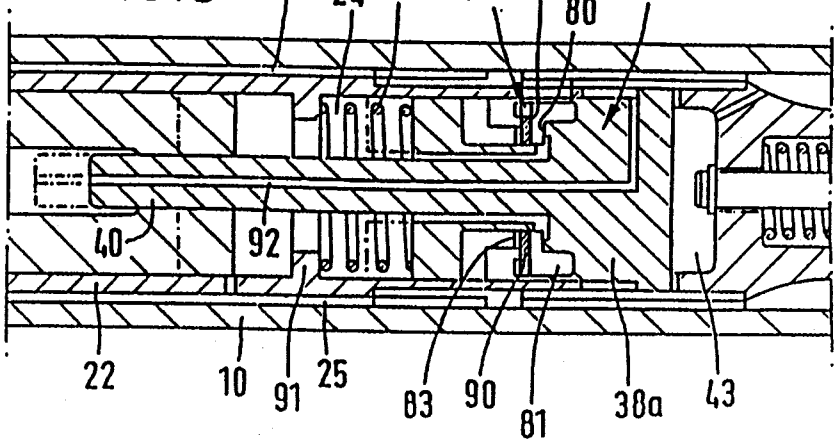
FIG. 8 shows an embodiment, wherein the adjusting piston of the adjusting means supports the stroke.

The embodiment of FIG. 8 is a further development of the one in FIG. 7 in that the adjusting piston 38*a*, connected to the control tube 40, simultaneously forms the rear end wall of the working cylinder. A change in the supply pressure will also change the position of the rear end wall so that the volume of the cylinder chamber is reduced when the supply pressure is increased. This pressure-dependent adjustment of the rear cylinder wall or a part of the cylinder wall supports the effect of the adjusting means 37. In FIG. 8, the spring 42 is provided inside the rear cylinder chamber 24 and supported at an annular collar 91 of the inner cylinder 22.

The annular space 81 is permanently connected with the supply pressure and the annular space 83 is constantly connected to the annular channel 25. The bore 92 of the control tube 40 is in permanent connection with a pressureless discharge channel (not illustrated).

Figure 9:
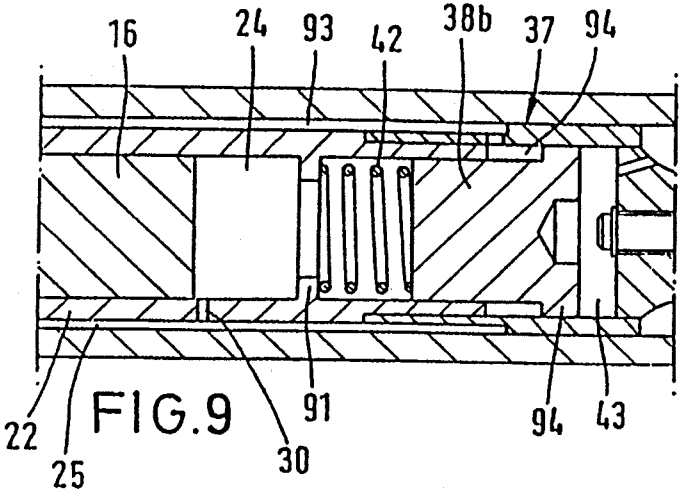
FIG. 9 shows an embodiment, wherein the adjusting means only displaces the rear end wall of the cylinder chamber.

In the embodiment of FIG. 9, the adjusting piston 38*b* defines the rear end wall of the working cylinder chamber 24 without a control tube, such as the control tube 40 of the earlier embodiments of the invention, being present. The adjusting piston 38*b* on which the supply pressure coming from the pressure chamber 43 acts, is supported at an annular collar 91 of the inner cylinder 22 by means of a spring 42. An annular space 94 connected to a relief channel 93 is arranged on the side of the annular collar 94 of the adjusting piston 38*b* facing away from the pressure chamber 43. The working piston 16 is solid, i.e. it does not have the bore 19 of the preceding embodiments.

The adjusting means 37 of FIG. 9 exclusively effects a pressure-dependent reduction of the volume of the working cylinder, absent adjustment of any other control elements.

Figure 10:
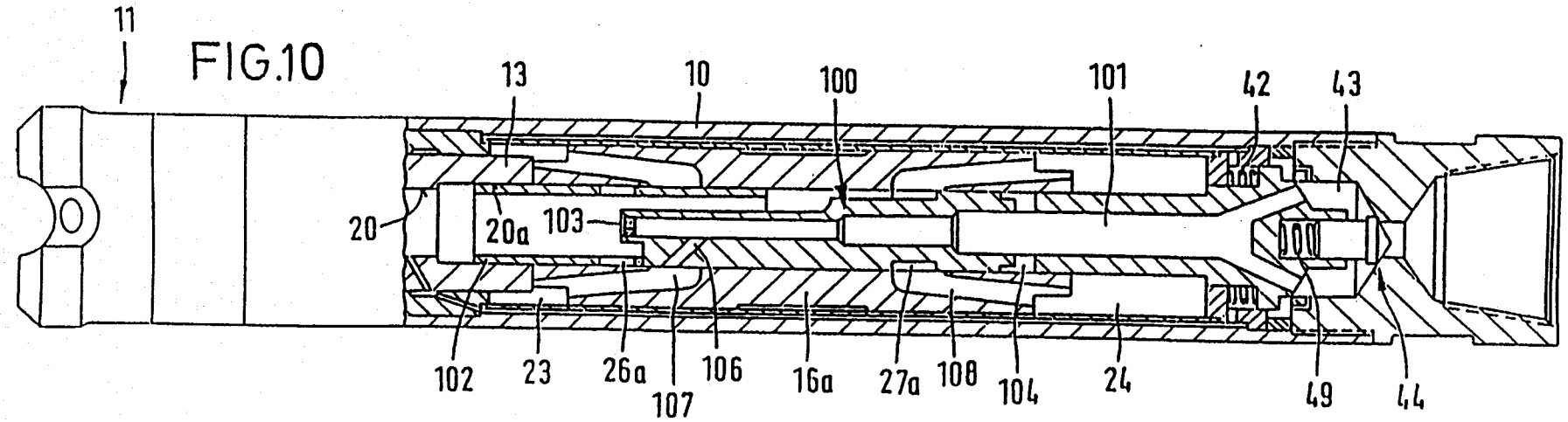
FIG. 10 shows an embodiment with a control tube entering the working piston for reversing the working piston.
Figure 11:
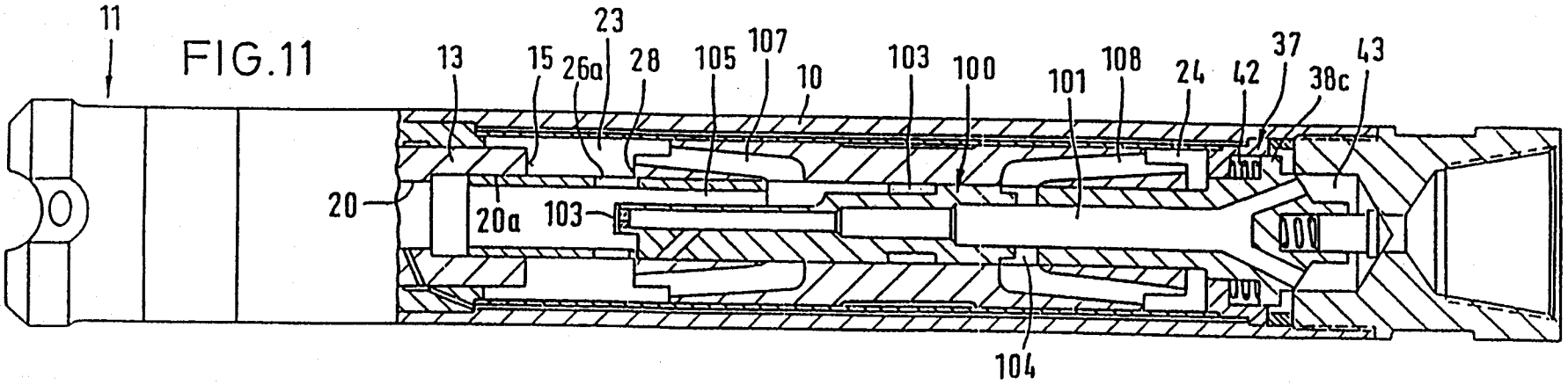
FIG. 11 shows the embodiment of FIG. 10 with the working piston being in the rear end position.

In the embodiment of FIGS. 10 and 11, a hollow working cylinder 16*a* is provided. In the longitudinal bore of the working piston 16*a*, there is arranged a control pin 100 having a longitudinally extending channel 101, as well as control bores 26*a* and a control groove 27*a*. The rear end of the control pin 100 is connected with the adjusting pin 38*c* that is urged towards the pressure chamber 43 by the spring 42. If the pressure in the pressure chamber 43 exceeds the force of the spring 42, the control pin 100 is displaced forward, i.e. towards the drill bit 11, inside the annular piston 16*a*.

The control pin 100 extends into an extended portion 20*a* of the longitudinal bore 20 of the drill bit shaft 13. In this end portion 102, there are provided control bores 26*a* that are permanently pressure-free, since they are connected to the longitudinal bore 20. Between the channel 101 and the longitudinal bore 20, a throttle opening 103 is arranged through which air may constantly flow out for supporting the flushing back of drillings.

The control pin 100 has an annular groove 104 connected to the channel 101, in which the supply pressure constantly prevails, as well as a control groove 27*a* that is permanently pressure-free by virtue of a channel 105. A transversal channel 106 is connected to the inside of the channel 101, the channel 106 being adapted to be aligned with a channel 107 of the annular piston 16*a*. A further channel 108 of the working piston may alternately be aligned with the control groove 27*a* or the annular groove 104.

FIG. 10 depicts the state of the device at the beginning of the return stroke. Through the channel 101, the transversal channel 106 and the channel 107, pressure will reach the front cylinder chamber 23 so that the front end surface 28 of the working piston will be lifted from the anvil 15 and move backward. The acceleration phase ends when the front end surface 28 reaches the area of the control bores 26*a*. In this phase, the rear cylinder chamber 24 is pressure-free by virtue of the channel 108, the control groove 27*a* and the channel 105. When the channel 108 has left the pressure-free control groove 27*a*, a pressure begins to build up in the rear cylinder chamber 24. The compression phase begins in which the rear cylinder chamber 24 is increasingly reduced until the channel 108 will reach the area of the pressurized annular groove 105. In doing so, additional compressed air enters the cylinder chamber 24. In the working stroke, the air in the cylinder chamber 24 relaxes, whereby the working piston can perform the drive phase until its end surface 28 finally hits on the anvil 15.

The effect of the displaceable control pin 100 is the following: With high supply pressures, the control pin is displaced forward. The advancing of the control bores 26*a* causes an earlier end of the acceleration phase so that the kinetic energy imparted to the piston is less. The advancing of the control groove 27*a* effects an earlier cut-off of the rear cylinder chamber 24 so that the compression phase starts earlier. Both measures, namely the shortening of the acceleration phase and the earlier beginning of the compression phase, the length of the return stroke is reduced and the energy imparted to the working piston during the working stroke is reduced, too. In this way, the impact energy imparted to the anvil is substantially the same irrespective of the supply pressure per impact. Although a preferred embodiment of the invention has been specifically illustrated and described herein, it is to be understood that minor variations may be made in the apparatus without departing from the spirit and scope of the invention, as defined the appended claims.

I claim:

1. A pneumatic hammer having a working piston (16) movable in a working cylinder (22) and defining therewith front and rear cylinder working chambers (23, 24), respectively, said working piston imparting impacts onto a drill bit via an anvil (15), and control member means provided at said working cylinder (22) and said working piston (16) for controlling the supply of compressed air to the cylinder working chambers (23, 24) at both ends of said working piston (16) such that, during a return stroke, said working piston (16) performs an acceleration phase and an air compression phase and, during a subsequent forward directed working stroke, said working piston (16) performs a drive phase and an impact on said anvil (15), characterized in that said working cylinder (22) having axially opposite forward and rear ends, and at the rear end of said working cylinder (22) there is provided an adjusting means (37) for adjusting the length of the return stroke of said working piston (16) in dependence on the supply pressure of the compressed air.

2. The pneumatic hammer of claim 1, wherein said adjusting means (37) is constructed and arranged for reducing the length of the return stroke in response to high supply pressure.

3. The pneumatic hammer of claim 1, wherein said adjusting means (37) is constructed and arranged for adjusting a control member (40) thereof to establish the beginning of the air compression phase of the return stroke.

4. The pneumatic hammer of claim 1, wherein said adjusting means (37) is constructed and arranged for adjusting a control member thereof to establish (100, 26*a*) the end of the acceleration phase of the return stroke.

5. The pneumatic hammer of claim 1, wherein said adjusting means (37) is constructed and arranged for adjusting the position of at least one part of a rear cylinder wall (76) of said working cylinder (22).

6. The pneumatic hammer of claim 1, wherein said adjusting means (37) includes an adjusting piston (38) actuated by the supply pressure.

7. The pneumatic hammer of claim 6, wherein said adjusting piston (38) is connected to a control tube (40) projecting into said working cylinder (22), which tube (40) enters a longitudinal bore (19) of said working piston (16).

8. The pneumatic hammer of claim 1, wherein a pressure-dependent reversing valve (75, 75*a*) is arranged behind said adjusting means (37) in the path of the compressed air, said valve (75, 75*a*) is controlled by the pressure in the rear cylinder chamber (24) of the working cylinder (22) and which, in the one position, leads the supply pressure into said rear cylinder working chamber (24) and, in another position, leads it into the front cylinder working chamber (23).

9. The pneumatic hammer of claim 1, wherein a control pin (100) is arranged in said working cylinder (22) for axial displacement by said adjusting means (37), said control pin (100) being connected with the supply pressure and having at least one lateral outlet (104, 106, 26*a*) cooperating with a control channel (107, 108) of said working piston (16).

* * * * *